US007140128B2

(12) United States Patent
Huckle

(10) Patent No.: US 7,140,128 B2
(45) Date of Patent: Nov. 28, 2006

(54) WORK BOOT WITH ANATOMICAL TONGUE

(76) Inventor: Kevin D. Huckle, 8 Kilkanny Place, Guelph, Ontario (CA) N1L 1H1

( * ) Notice: Subject to any disclaimer, the term of this patent is extended or adjusted under 35 U.S.C. 154(b) by 228 days.

(21) Appl. No.: 10/843,329

(22) Filed: May 12, 2004

(65) Prior Publication Data

US 2005/0252040 A1 Nov. 17, 2005

(51) Int. Cl.
*A43B 23/26* (2006.01)

(52) U.S. Cl. ..... 36/54; 36/71; 36/88; 36/45

(58) Field of Classification Search ..... 36/45, 36/54, 88, 89, 93, 71
See application file for complete search history.

(56) References Cited

U.S. PATENT DOCUMENTS 4,726,126 A * 2/1988 Bernhard ..... 36/89
5,050,319 A * 9/1991 Perotto et al. ..... 36/117.6
5,575,090 A * 11/1996 Condini ..... 36/54
5,924,218 A * 7/1999 Dalvy et al. ..... 36/55
5,955,159 A * 9/1999 Allen et al. ..... 428/34.1
5,985,383 A * 11/1999 Allen et al. ..... 428/34.1
6,237,253 B1 * 5/2001 Feuerecker ..... 36/54
6,442,875 B1 * 9/2002 Joubert et al. ..... 36/115
2002/0083622 A1 * 7/2002 Joubert et al. ..... 36/117.6

* cited by examiner

*Primary Examiner*—Marie Patterson
(74) *Attorney, Agent, or Firm*—Daryl W. Schnurr

(57) ABSTRACT

A work boot has an anatomical tongue that is asymmetrical about a longitudinal line of the tongue extending vertically upward from a mind-point of a bottom of said tongue. The tongue contains memory foam and shapes itself to a particular user. The memory foam causes the tongue to retain its shape. The side walls of the boot have J-bars extending inward therefrom. The J-bars also contain memory foam to comfortably fit the foot of a particular user.

11 Claims, 14 Drawing Sheets

WORK BOOT WITH ANATOMICAL TONGUE

BACKGROUND OF THE INVENTION

1. Field of Invention

This invention relates to a work boot having an anatomical tongue that contains memory material that conforms to the foot and shin of a user. Further, this invention relates to J-bars that are located on either side of the boot above a heel. The J-bars also contain memory material and are located and shaped to extend beneath and to a rear of an ankle bone of the user.

2. Description of the Prior Art

Work boots are known. Difficulty has been encountered in designing a work boot that is comfortable, yet fits snugly and has a reasonable cost. In order to achieve a reasonable cost, work boots must be designed to fit various users. If work boots are too snug, they can be difficult to put on and to remove. They can also be extremely uncomfortable. If a work boot is too loose, it can be unsafe and can cause the user to slip, stumble or fall. Work boots are usually worn for long periods of time and are subject to significant stress. With time, a tongue of the work boot which may be centrally located at the beginning of a work day, will move toward one side. The movement of the tongue can expose the user to injury and also make the wearing of the work boot uncomfortable. The tongue will often deteriorate with time and move more quickly to a deformed position.

Difficulty has also been encountered in sizing the heel portion of the upper. If the heel portion is too small, while the heel portion will fit snugly, it will be extremely uncomfortable to wear the work boot, especially for a long period of time. Further, if the heel portion is too large, the heel of the user will readily lift off the sole as the work boot is worn. This can be unsafe for the user and can result in difficulty in walking.

SUMMARY OF INVENTION

It is an object of the present invention to provide a work boot having an anatomical tongue that is asymmetrical about a longitudinal centre line and contains a memory material that results in the tongue conforming to a shape of a foot and shin of the user. It is a further object of the present invention to provide a tongue on a work boot where the tongue will remain in a centrally located position throughout the workday. It is still a further object of the present invention to provide a work boot having J-bars on either side of the upper above a heel. The J-bars are formed of memory material and extend inward to provide a snug yet comfortable fit to the user.

A work boot for use by a user has a sole, heel and upper. The upper has an anatomical tongue, the tongue having a top, bottom, medial side and lateral side. The bottom has a mid-point between the two sides of the tongue. The tongue being asymmetrical about an imaginary longitudinal line extending upward from the mind-point of the bottom along the tongue in a vertical plane. The vertical plane extends through the mind-point of the bottom and trough a longitudinal centre axis of said sole. The tongue contains a layer of memory material, the memory material being located to cause the tongue to conform to a shape of a foot and shin of the user through use of the tongue. The memory material causes the tongue to retain the shape for subsequent-use. An area of the tongue on the lateral side of the imaginary longitudinal line is much larger than an area of the tongue on the medial side of the line.

A work boot for use by a user comprises a sole, heel and upper, the upper having an anatomical tongue. The tongue has a top, bottom, medial side and lateral side, the bottom having a mid-point between the two sides. When the tongue is in a vertical position, the tongue has an imaginary longitudinal line extending vertically upward from the mid-point of the bottom to the top. The tongue contains a layer of memory material, the memory material being located to cause the tongue to conform to a shape of a foot and shin of the user through the use of the tongue. The memory material causes the tongue to retain the shape for subsequent use. An area of the tongue on the lateral side of the imaginary longitudinal line is much larger than an area of the tongue on the medial side of the imaginary longitudinal line.

A work boot for use by a user comprises a sole, heel and upper, the upper having an anatomical tongue. The tongue has a top, bottom, medial side and lateral side. The bottom has a mid-point between the two sides. When the tongue is in a vertical position, the tongue has an imaginary longitudinal line extending upward from the mid-point to the top. The imaginary longitudinal line lies in a vertical plane, the vertical plane being aligned with an ankle instep molding line of the boot.

A work boot for user by a user has a sole, heel and upper. The upper has a lateral sidewall and a medial sidewall. The upper has a tongue with two sides. The two sides each have a J-bar located above the heel. Each J-bar has an apex with a substantially horizontal arm and a substantially vertical arm extending from the apex. The horizontal arm is located at a level that is just beneath an ankle bone of the user. The vertical arm is located to a rear of the ankle bone. The J-bars extend inward from the side walls of the upper and are formed from memory material.

DESCRIPTION OF A PREFERRED EMBODIMENT

Figure 1:
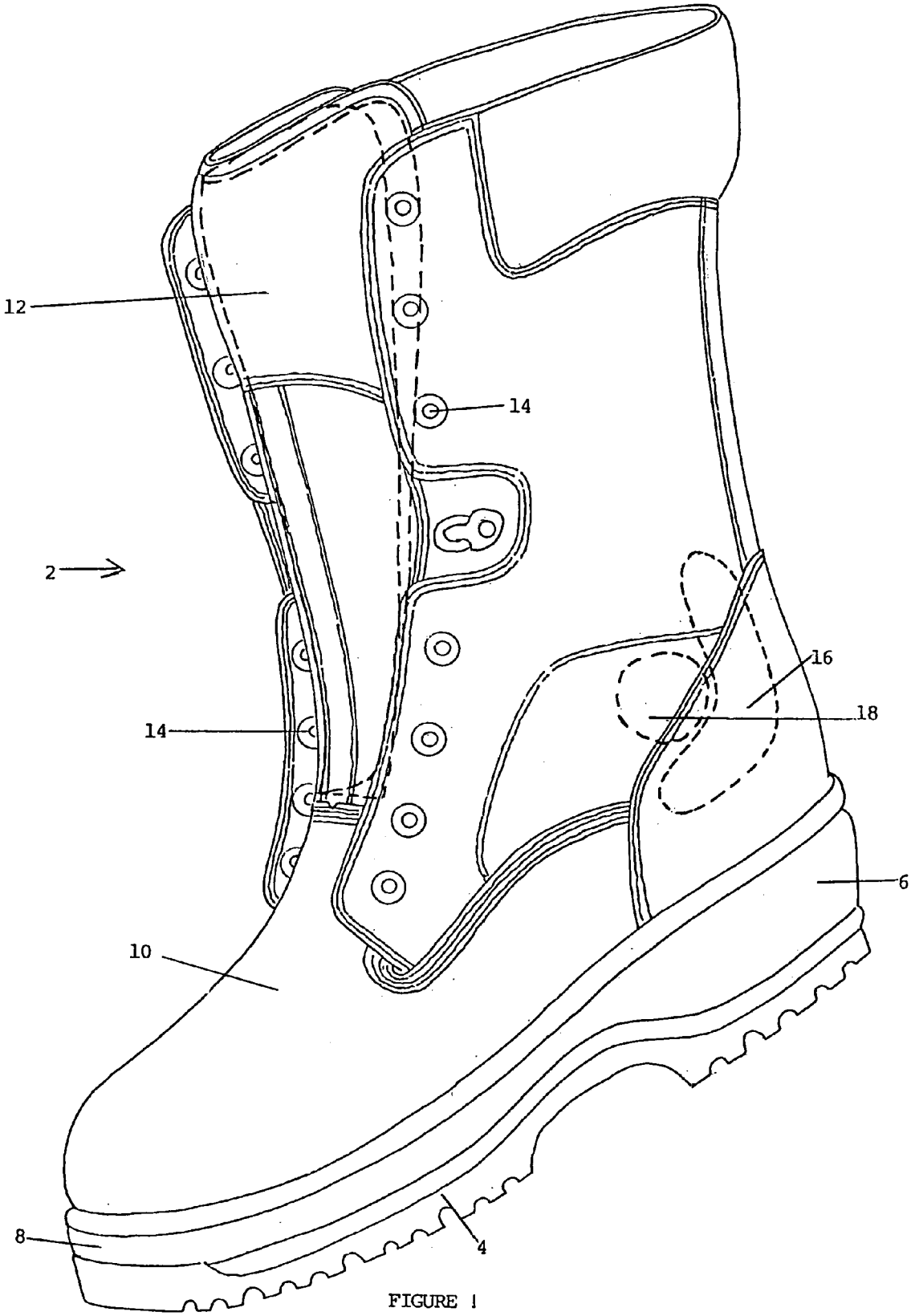
FIG. 1 is a partially schematic perspective view of a work boot having an anatomical tongue and a J-bar located in an upper.

In FIG. 1, a work boot 2 has a sole 4, heel 6, toe 8 and upper 10. The upper is affixed to the sole in a conventional manner. The upper has an anatomical tongue 12 installed therein shown schematically by dotted lines. Eyelets 14 for laces (not shown) extend along each side of the tongue 12 and are conventional.

By dotted lines, there is shown a J-bar 16 and an imaginary location of an ankle bone 18.

Figure 2:
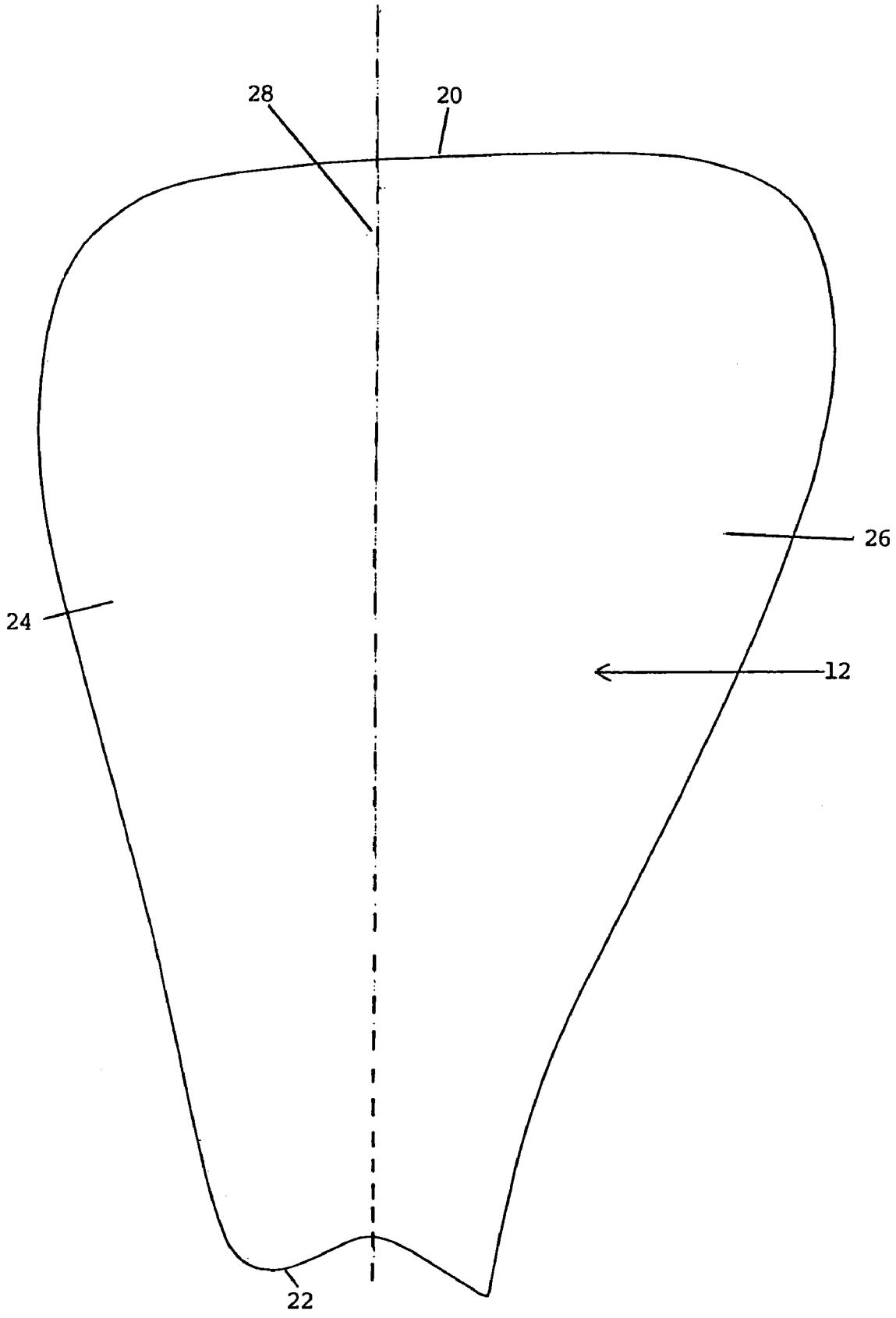
FIG. 2 is a front view of an anatomical tongue for a left foot.

In FIG. 2, there is shown a front view of the tongue 12 of FIG. 1. The tongue has a top 20, bottom 22, medial side 24 and lateral side 26. A dotted line 28 represents an imaginary longitudinal line of the tongue and extends from a mid-point of the bottom 22 vertically upward to the top 20. The longitudinal line 28 is aligned with an ankle in-step molding line of the boot (not shown in FIG. 2). The top 20 slopes downward from the lateral side 26 to the medial side 24 and the corners between the top and the two sides are rounded. The lateral side is much larger relative to the longitudinal line than the medial side. The lateral side 26 extends outside and the medial side extends inside of a foot and shin (not shown) of a user (not shown).when the work boot is worn.

Figure 3:
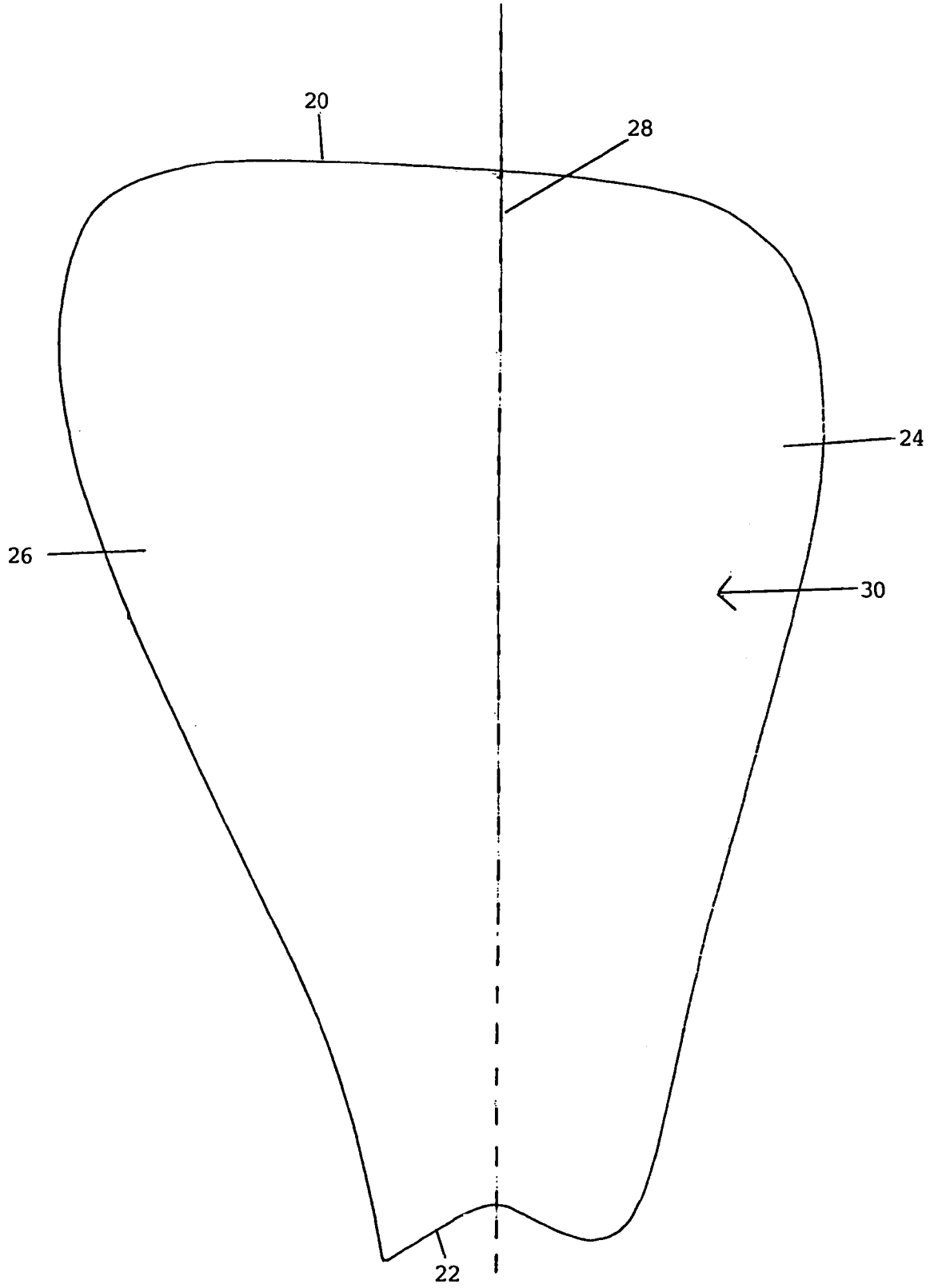
FIG. 3 is a front view of an anatomical tongue for a right foot.

In FIG. 3, there is shown a front view of an anatomical tongue 30 that is used for the right work boot (not shown). It can be seen that the tongue 30 is a mirror image of the tongue 12, which is for the left foot, shown in FIG. 2. The same reference numerals are used to refer to those components of FIG. 3 that are identical to the components of FIG. 2.

Figure 4:
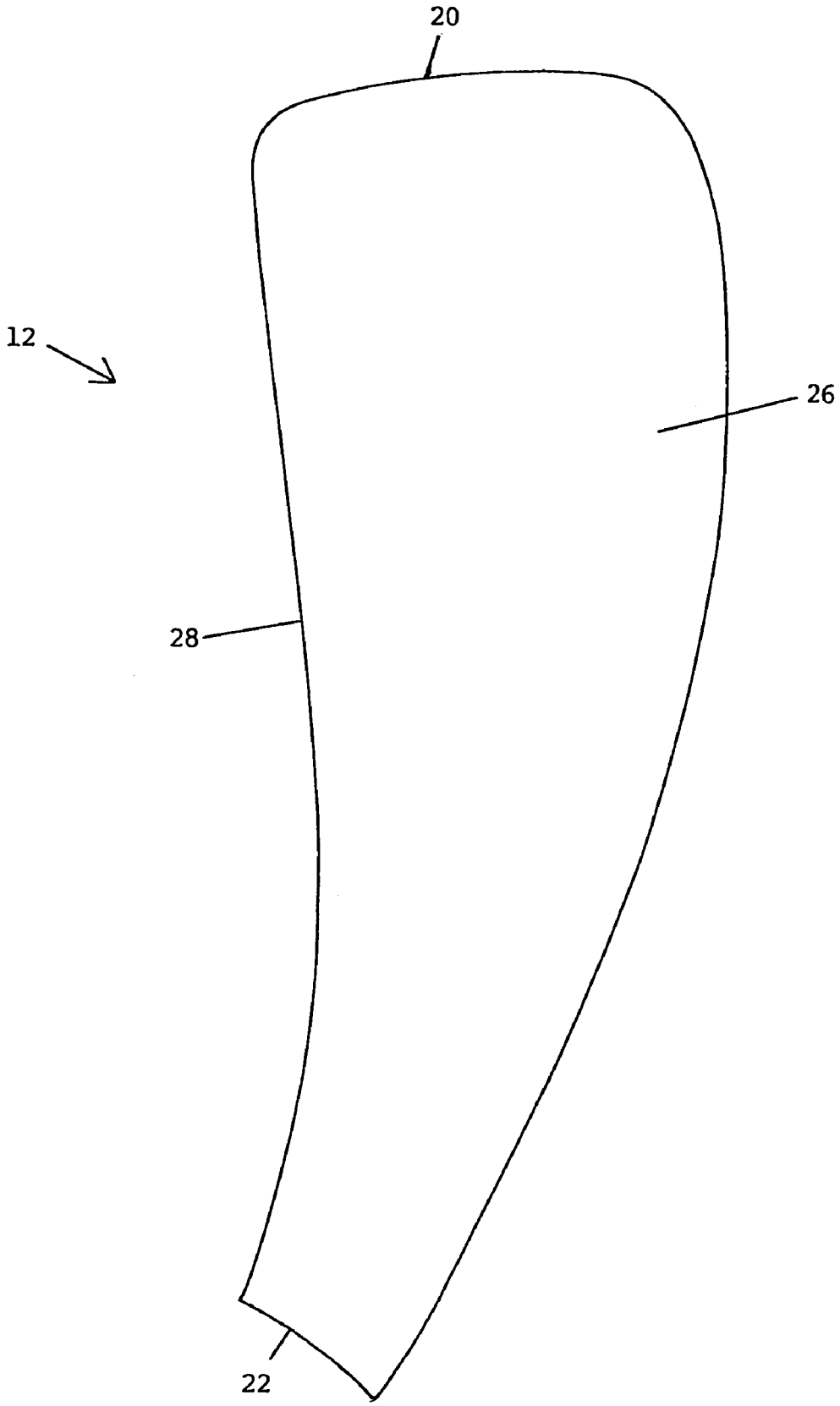
FIG. 4 is a side view of an anatomical tongue for the left foot when viewed from a lateral side for a left foot.
Figure 5:
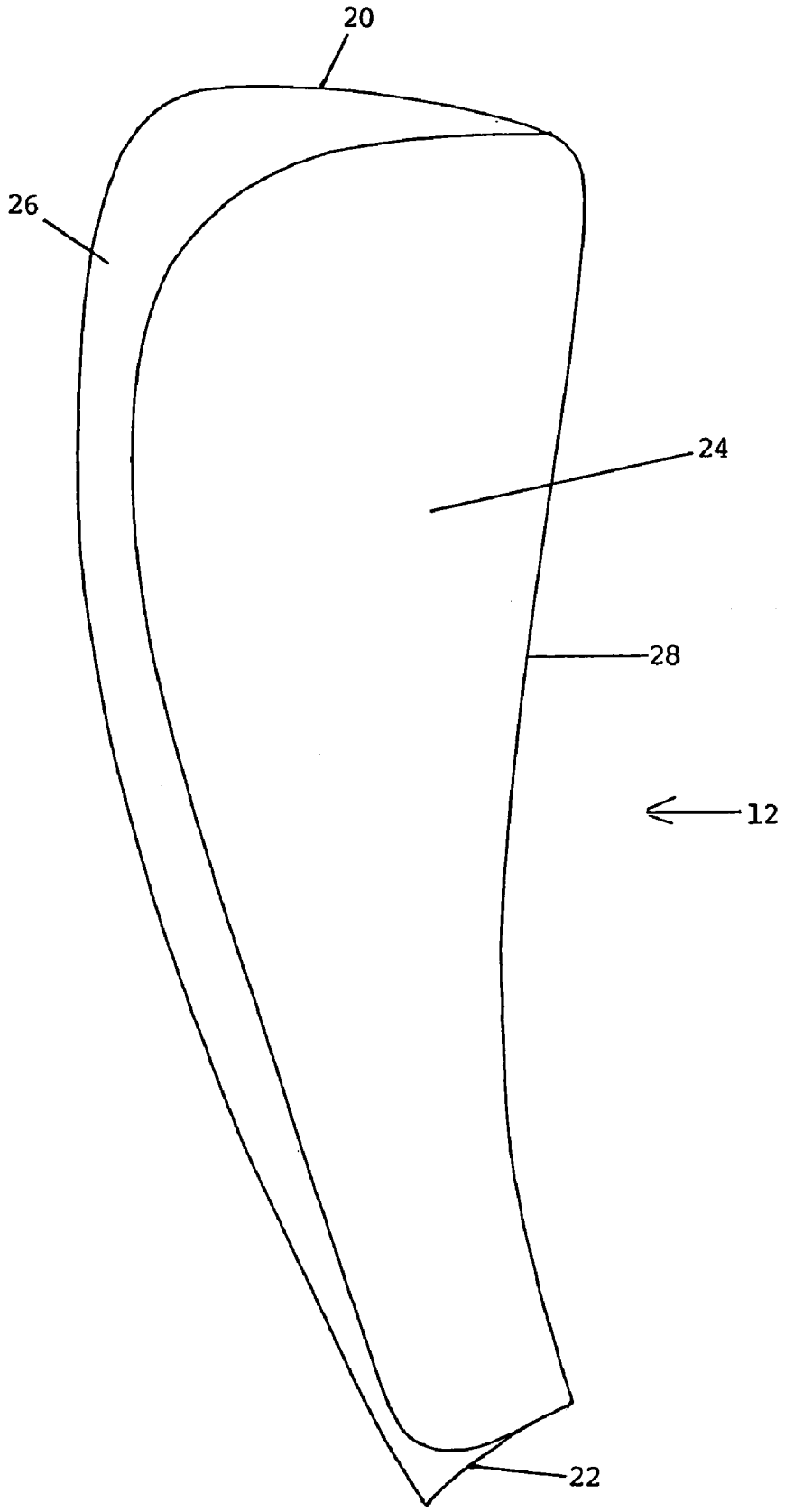
FIG. 5 is a side view of an anatomical tongue for a left foot when viewed from a medial side.
Figure 6:
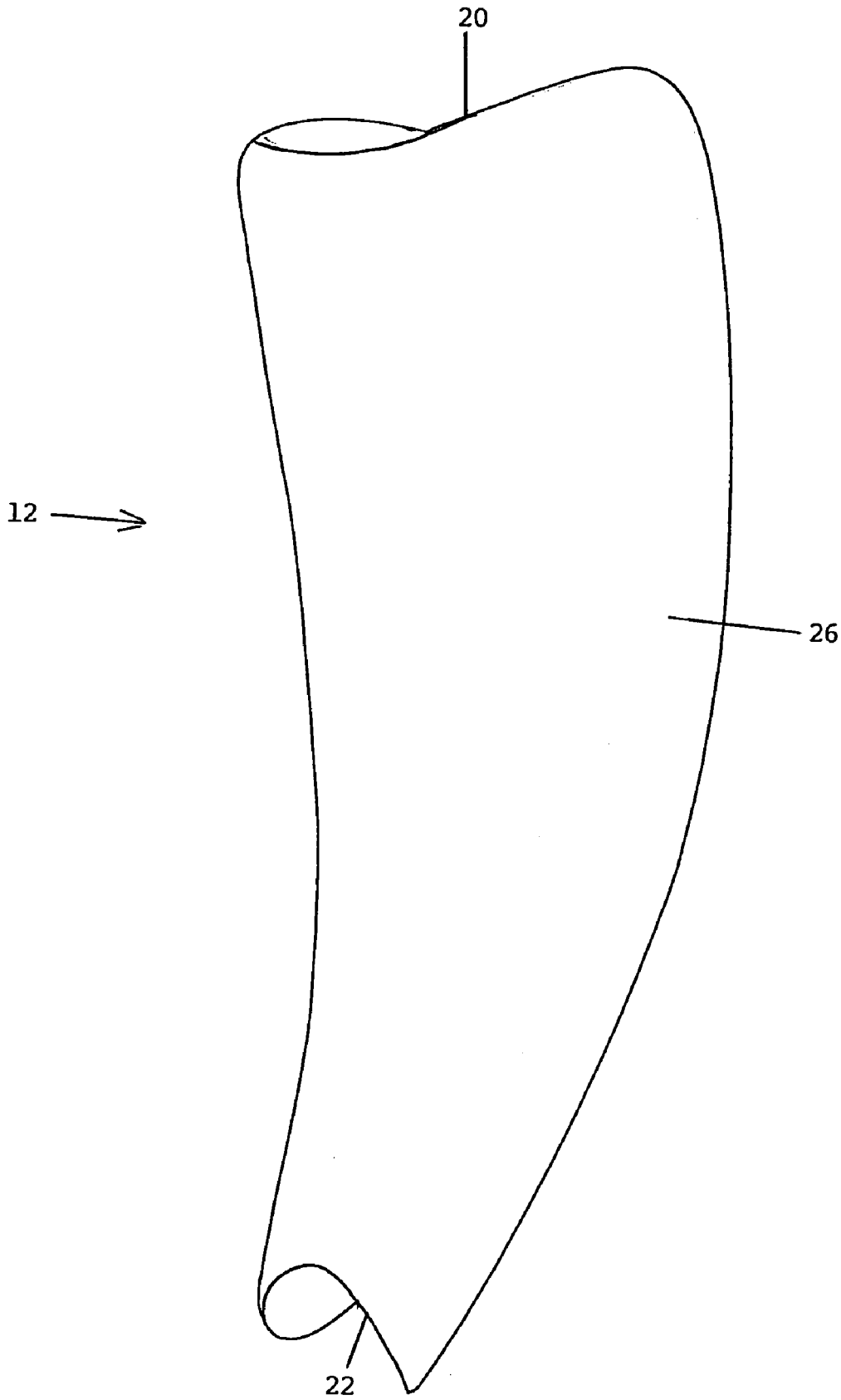
FIG. 6 is a prospective view of an anatomical tongue for a left foot when viewed from a lateral side.
Figure 7:
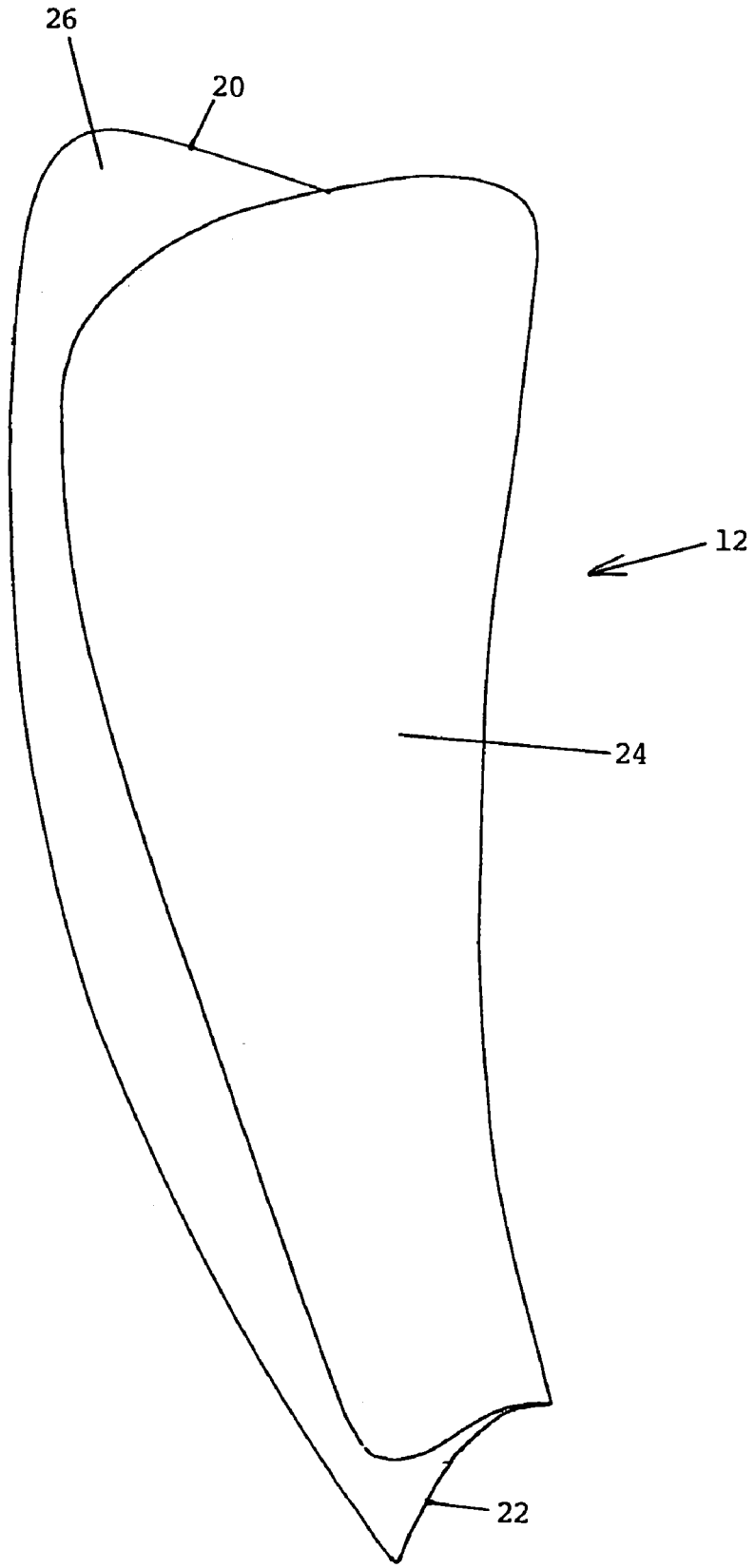
FIG. 7 is a prospective view of an anatomical tongue for a left foot when viewed from a medial side.
Figure 8:
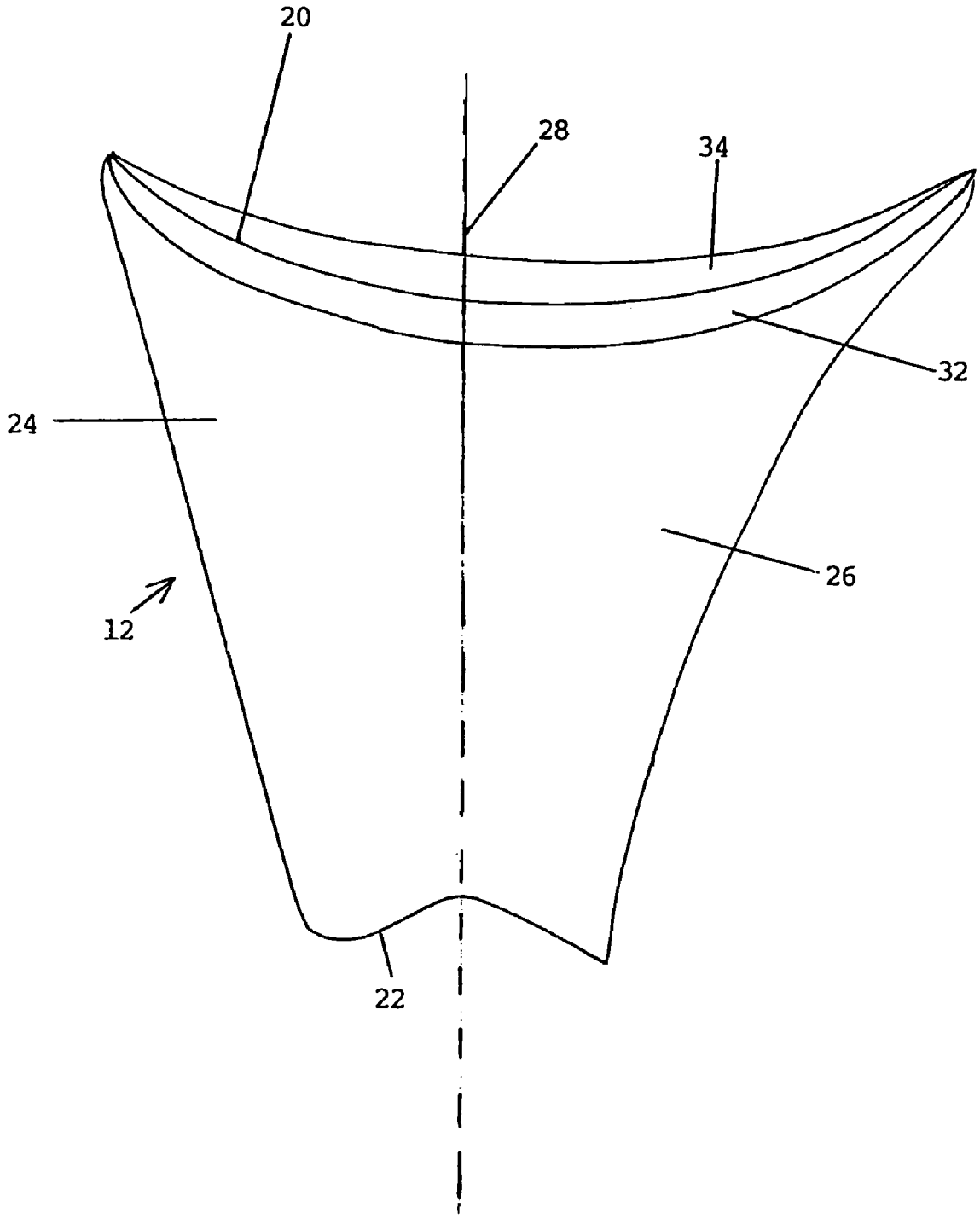
FIG. 8 is a top view of a tongue for the left foot.

In FIG. 4, there is shown a side view of the anatomical tongue 12 folded along the longitudinal line 28 when viewed from the lateral side 26. In FIG. 5, there is shown a side view of the tongue 12 folded along the longitudinal line 28 when viewed from the medial side 24. It can be seen that the lateral side 26 is significantly larger than the medial side 24. In FIG. 6, there is shown a prospective view of the tongue 12 when viewed from the lateral side 26 and in FIG. 7 there is shown a prospective view of the tongue 12 when viewed from the medial side 24. In FIG. 8, there is shown a top view of the tongue 12. It can be seen that the tongue 12 has an outer layer 32 and an inner layer 34. Both layers, smoothly taper to the sides 24, 26. The inside layer 32 is preferably made from memory material and is preferably memory foam. The memory foam will substantially retain its shape when used repeatedly in a particular manner. FIGS. 4 to 8 inclusive, show the tongue 12 for the left work boot (not shown in FIGS. 4 to 8) for use with the left foot of the user. The tongue for the right work boot is the tongue 30 shown in FIG. 3. Corresponding drawings to FIGS. 4 to 8 for the right tongue are not shown, but the right tongue is a mirror image of the drawings shown in FIGS. 4 to 8, inclusive. The same reference numerals are used in FIGS. 4 to 8 as those used in FIG. 2 to describe those components that are identical.

Figure 9:
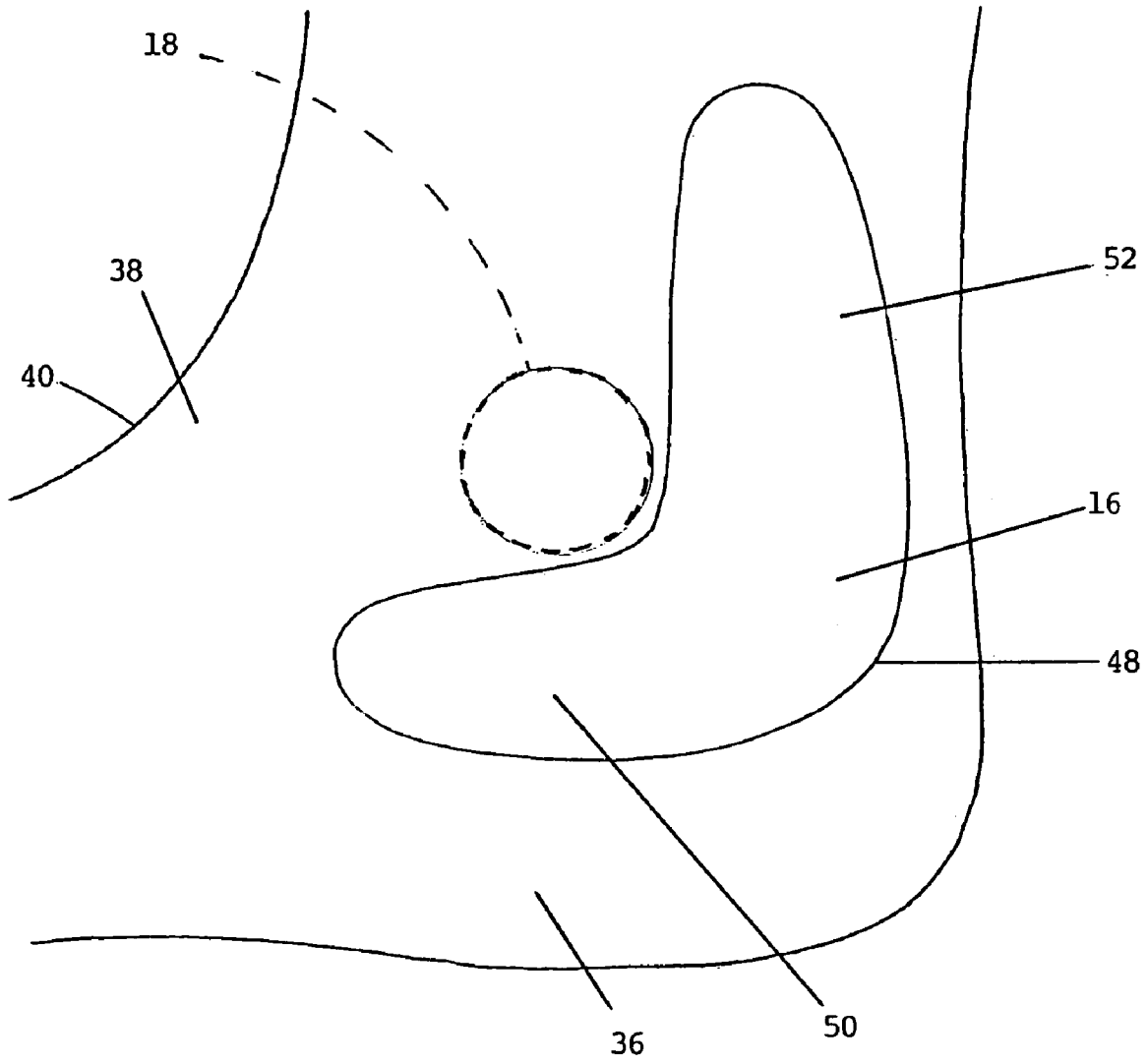
FIG. 9 is a schematic partial side view of an outside of a left foot of a user with a J-bar superimposed thereon.

In FIG. 9, there is shown a partial side view of an outside 36 of a left foot 38 of a user with the J-bar 16 superimposed thereon. A location of the ankle bone 18 is schematically designated by a dotted circle. The left foot 38 has an instep 40. By way of example only, a centre of the ankle bone is approximately 63 mm vertically downward to a bottom of the foot 38. The distance of a bottom of the J-bar to the bottom of the foot is approximately 23 mm. Similarly, a distance from a centre of the ankle bone to a rear of the foot 38 is approximately 50 mm. A distance from a rear of the J-bar to the rear of the foot is approximately 6 mm. These distances are provided as an example only and actual distances will vary both for work boots of the same size and for work boots of different sizes.

Figure 10:
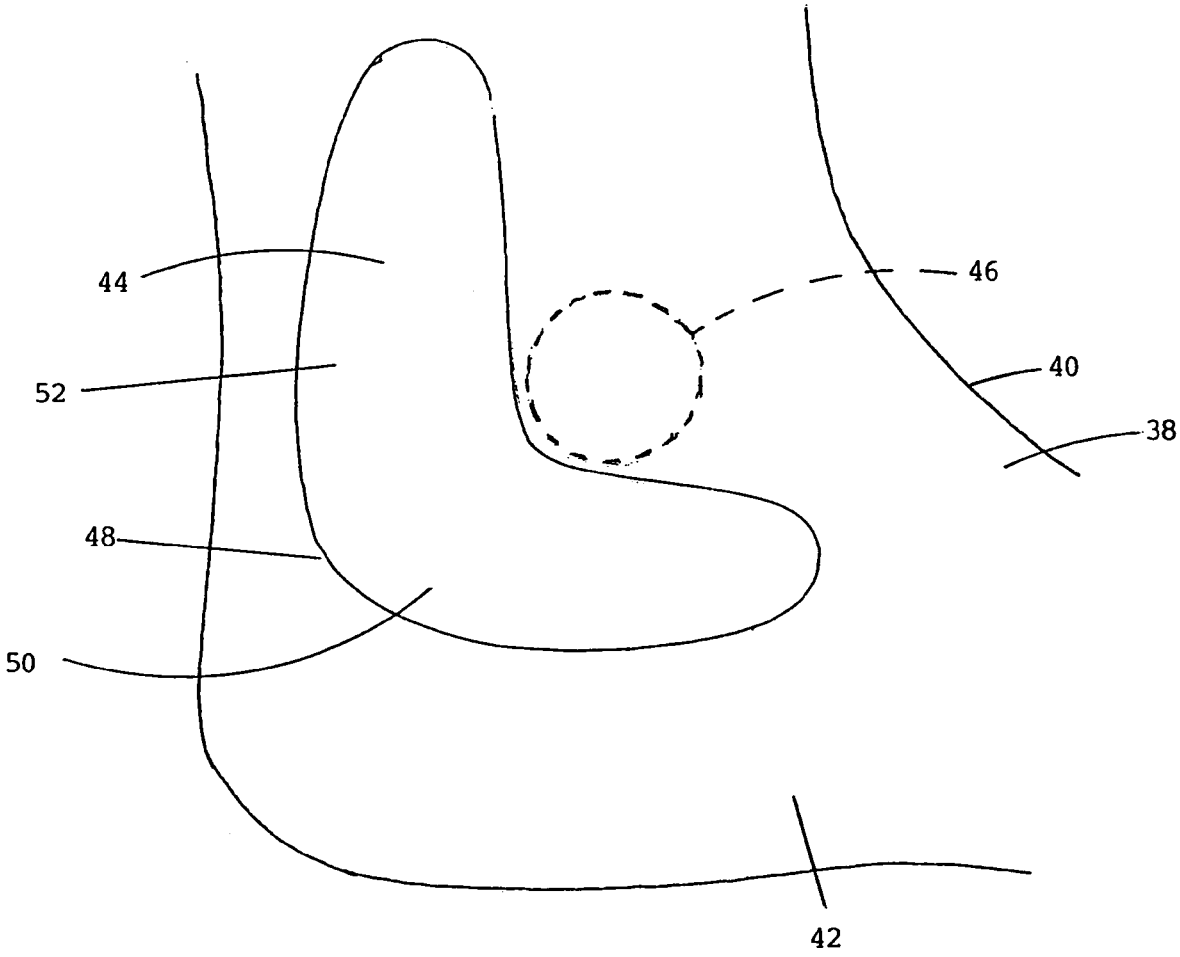
FIG. 10 is a schematic side view of an inside of a left foot of a user with a J-bar superimposed thereon.

In FIG. 10, there is shown a partial schematic side view of an inside 42 of the left foot 38 with a J-bar 44 superimposed thereon relative to an ankle bone 46, which is represented by a dotted circle. The distance from a centre of the ankle bone 46 to a bottom of the foot is approximately 72 mm and a distance from the bottom of the J-bar 44 to the bottom of the foot is approximately 32 mm. Similarly, a distance from a centre of the ankle bone 46 to a rear of the foot 38 is approximately 54 mm and a distance from a rear of the J-bar to a rear of the foot is approximately 10 mm. These distances are provided as an example only and actual distances will vary both for work boots of the same size and for work boots of different sizes.

From FIGS. 9 and 10, it can be seen that the J-bar 16 on the outside of the foot 38 is located at a lower level than the J-bar 44 on the inside of the foot 38. Similarly, the J-bar 16 on the outside of the foot 38 is located closer to a rear of the foot than the J-bar 44 located on the inside of the foot 38. Each of the J-bars 16, 44 have an apex 48 with a substantially horizontal arm 50 and a substantially vertical arm 52. Each J-bar is preferably located so that the horizontal arm is just beneath the ankle bone and that the vertical arm is just to the rear of the ankle bone. The J-bars on the inside and outside of the left foot are located in different locations as the ankle bone of the user on the inside of the foot is located differently from the ankle bone of the user on the outside of the foot. The foot 38 has a heel 41.

Figure 11:
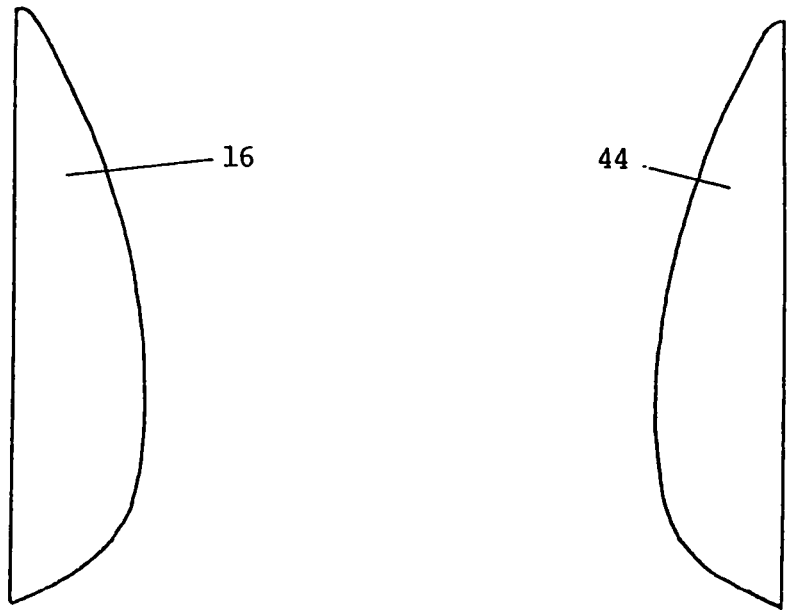
FIG. 11 is a schematic rear view of two J-bars when viewed from a heel.
Figure 12:
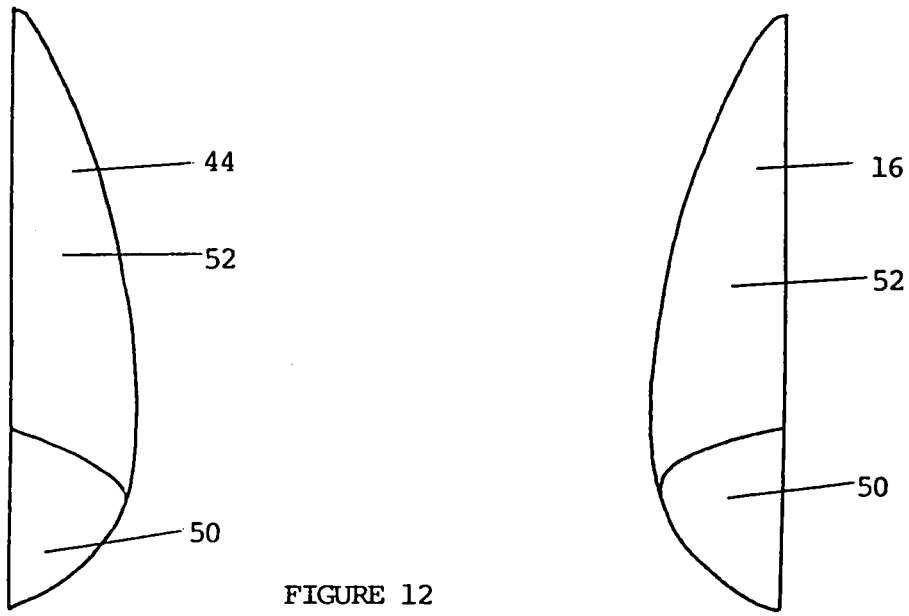
FIG. 12 is a schematic front view of two J-bars when viewed from a toe.

In FIG. 11, there is shown a schematic rear view of J-bars 16, 44 of the left work boot (not shown). The J-bar 16 would be located on the outer side of the left work boot and the J-bar 44 would be located on the inside of the left work boot (not shown). Both J-bars 16, 44 extend inward within a cavity defined by the upper above the heel (not shown). The purpose of FIG. 12 is to show the shape of the J-bars when viewed from the rear. The J-bars 16, 44 are located at the same height in FIG. 12 but when the J-bars are included within a boot, the two J-bars are located at different heights.

In FIG. 12, there is shown a front view of the J-bars 16, 44 when viewed from a toe of the work boot (not shown) the vertical arm 52 can be distinguished from the horizontal arm 50 of each of the J-bars 16, 44. In FIGS. 11 and 12 the height of the J-bars 16, 44 relative to one another should be ignored. It can be seen from FIGS. 11 and 12, that the J-bars will assist in making the boot fit better, making the boot more comfortable and will also assist in supporting the ankle of a user.

Figure 13:
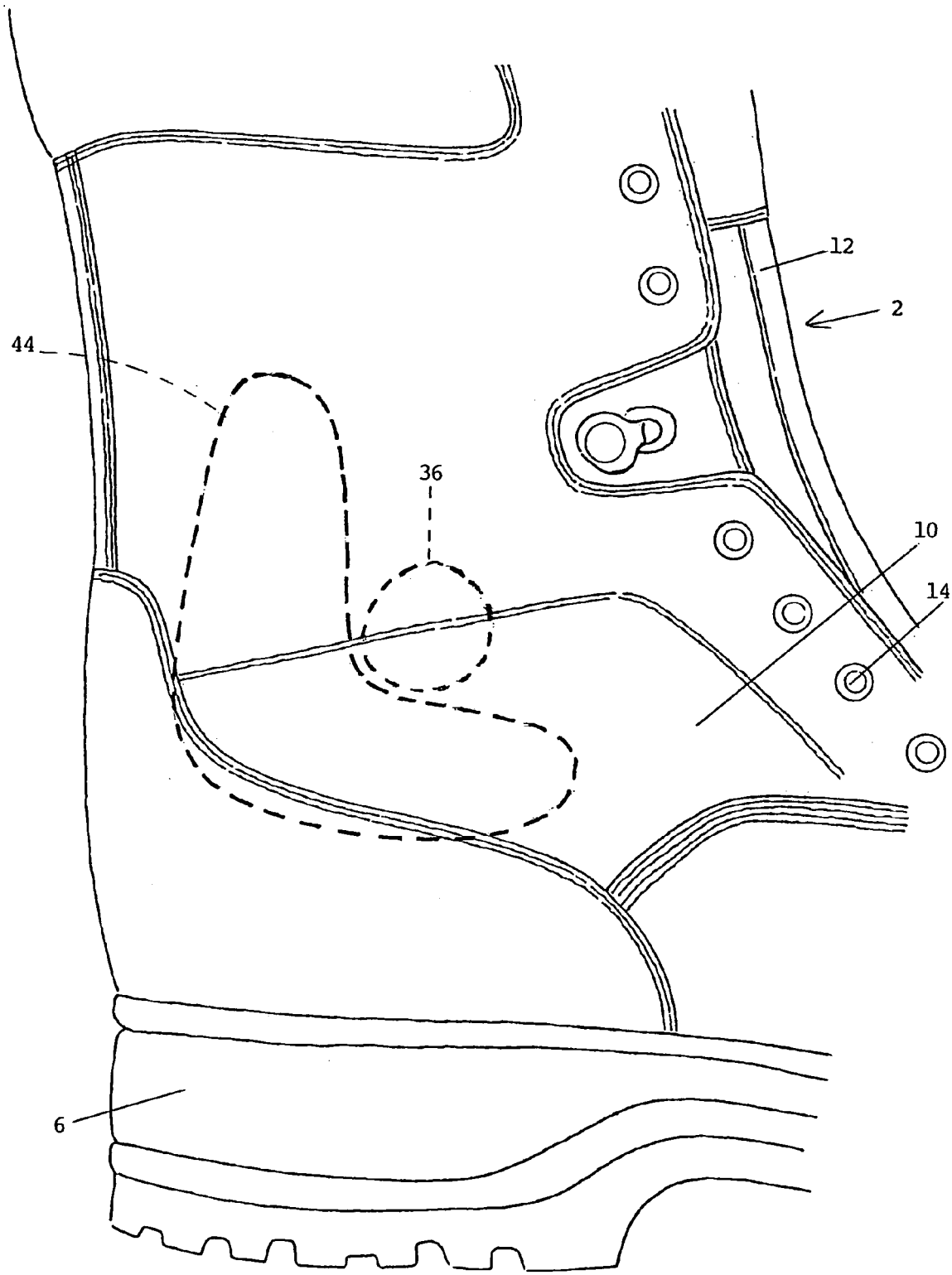
FIG. 13 is a partial side view of a work boot for the inside of a left foot with the J-bar and ankle bone superimposed thereon.

In FIG. 13, there is shown a partial side view of the work boot 2 with a location of the J-bar 44 and ankle bone 36 imposed thereon by dotted lines. The J-bar 44 is located on the inside of the boot as it is the left work boot that is shown.

Figure 14:
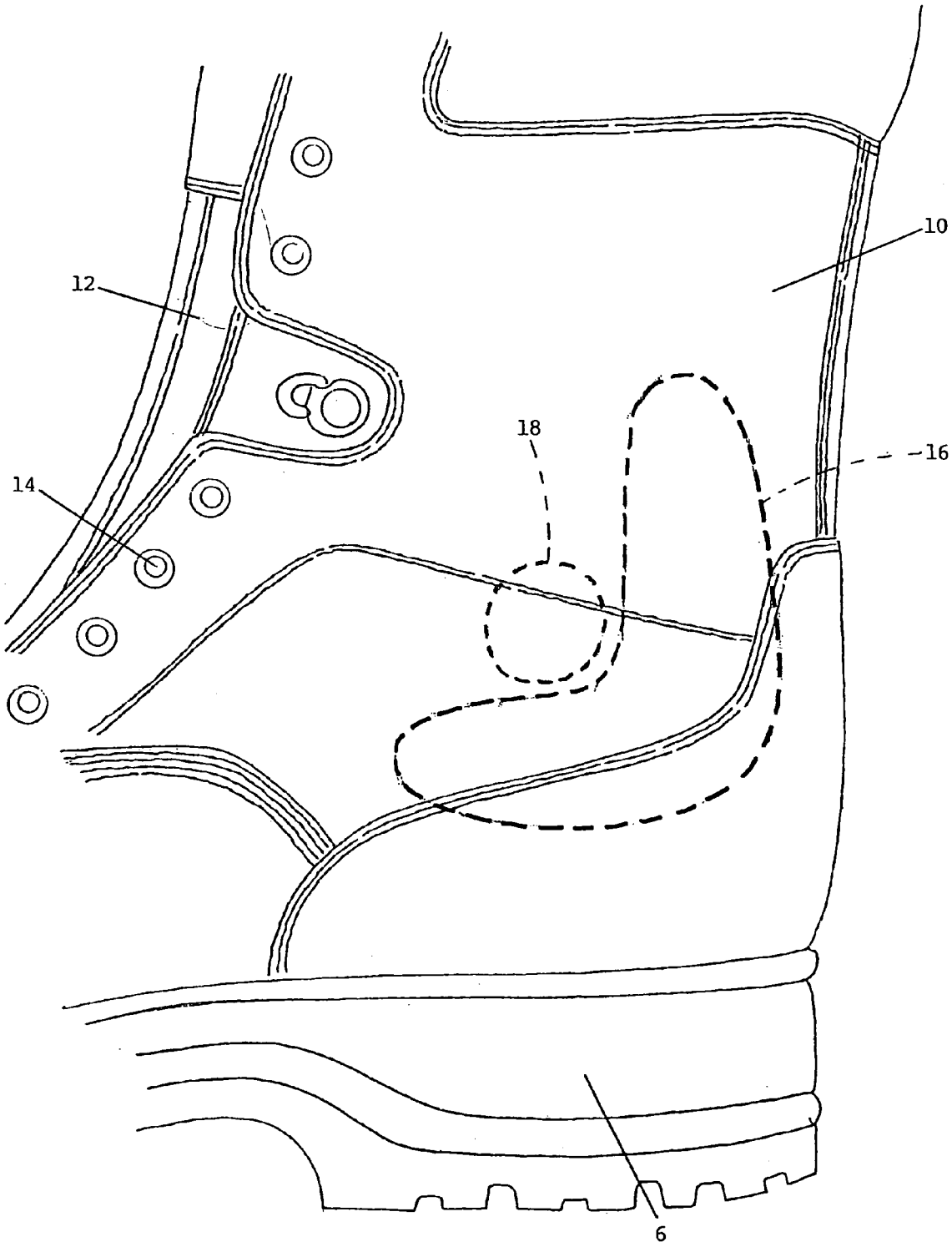
FIG. 14 is a partial side view of a work boot for an outside of a left foot with the J-bar and ankle bone superimposed thereon.

In FIG. 14, there is shown a partial side view of the work boot 2 with the J-bar 16 and ankle bone 18 superimposed thereon. Since the work boot 2 is the left boot, the J-bar 16 would be on the outer side of the boot.

Figure 15:
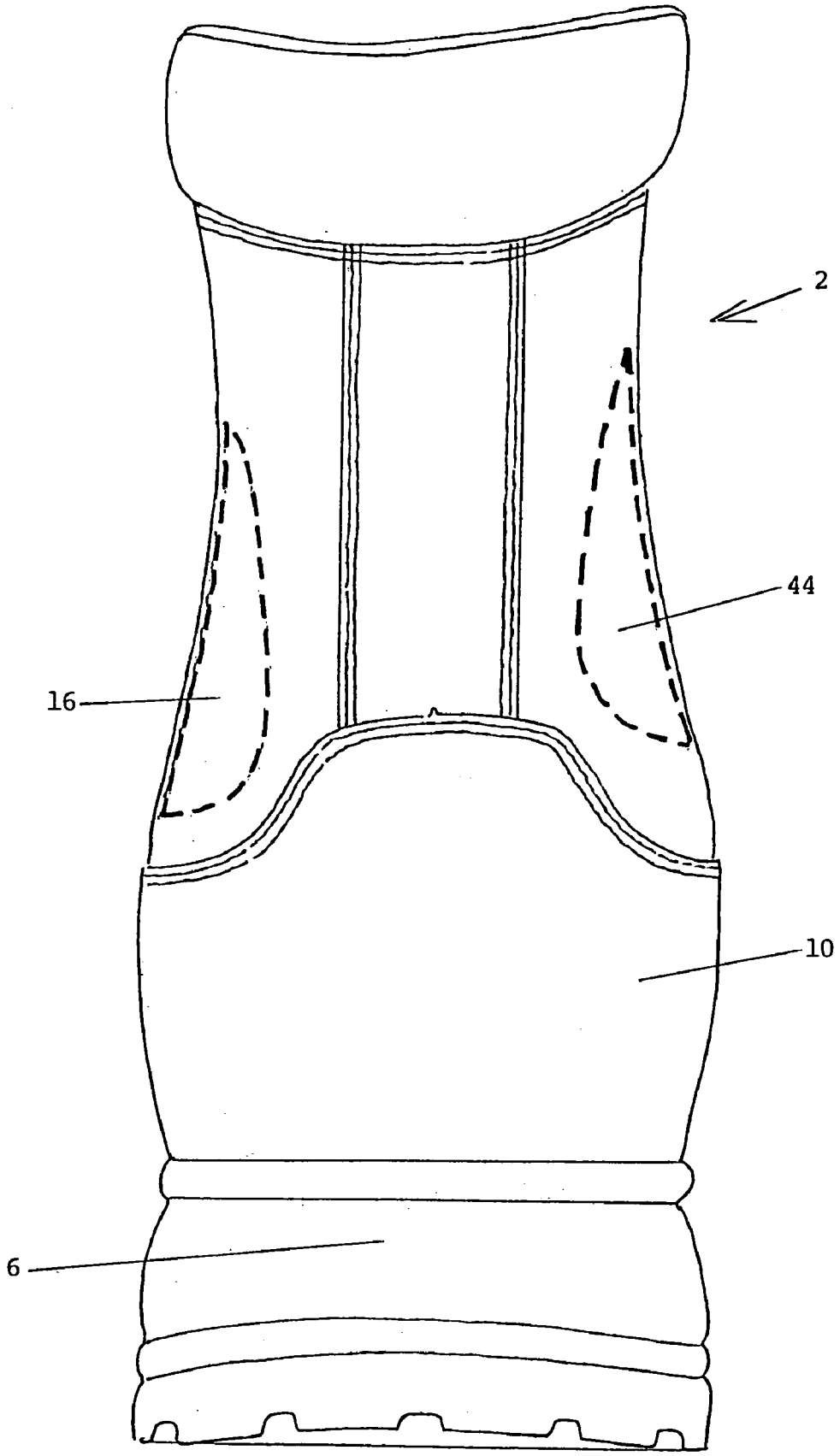
FIG. 15 is a rear view of a work boot for a left foot with the J-bars superimposed thereon.

In FIG. 15, there is shown a rear view of the work boot 2 for the left foot. It can be seen that the J-bar 16 is located on the lateral side 54 of the work boot 2 and the J-bar 44 is located on a medial side 56 of the work boot 2. The ankle bones 18, 46 are shown by dotted lines within the work boot 2. It can also be seen that the J-bar 16 is located at a lower level than the J-bar 44 within the work boot 2. The same reference numerals are used in FIGS. 13 to 15 as those used in FIGS. 1 to 9 for those components that are identical.

While it is the left work boot or left tongue that is shown in all of the drawings except for FIG. 3, the right work boot is simply a mirror image of the left work boot and left tongue. The J-bars 16, 44 will be switched around on the right work boot so that the medial side J-bar is still located above the lateral side J-bar. The J-bars for the right work boot will also be the mirror image of the J-bars for the left work boot. The J-bars can have a J-shape or an L-shape that is similar to a J-shape or L-shape. Preferably, the J-bars have an L-shape.

I claim:

1. A work boot for use by a user, said work boot comprising a sole, heel and upper, said upper having an anatomical tongue, said tongue having a top, bottom, medial side and lateral side, said bottom having a mid-point between said two sides, said tongue being asymmetrical about an imaginary longitudinal line extending upward along said tongue in a vertical plane through said mid-point of said bottom, said vertical plane extending through a longitudinal center axis of said sole, said tongue containing a layer of memory material, said memory material being located to cause said tongue to conform to a shape of a foot and shin of said user through use of said tongue, said memory material causing said tongue to retain said shape for subsequent use, an area of said tongue on said lateral side of said imaginary longitudinal line being much larger than an area of said tongue on said medial side of said imaginary longitudinal line.

2. A work boot as claimed in claim 1 wherein said upper of said work boot has two side walls above said heel with J-bars thereon, each side wail having a J-bar extending inward into a cavity of said upper, each J-bar having a substantially horizontal arm and a substantially vertical arm extending from an apex of said ankle support, said horizontal arm being located at a level that is just beneath an ankle bone of said user, said vertical arm being located just behind an ankle bone of said user, said J-bar extending inward from said side walls with one J-bar on each side wall and being formed from memory material, said J-bars conforming to an ankle of said user.

3. A work boot as claimed in claim 2 wherein said J-bar on said lateral side is located at a lower level than said J-bar on said medial side.

4. A work boot as claimed in claim 3 wherein said memory material and said J-bar is memory foam.

5. A work boot as claimed in claim 2 wherein each J-bar has an L-shape or a J-shape.

6. A work boot for use by a user, said work boot comprising a sole, heel and upper, said upper having an anatomical tongue, said tongue having a top, bottom, medial side and lateral side, said bottom having a mid-point between said two sides, when said tongue is in a vertical position, said tongue having an imaginary longitudinal line extending vertically upward from said mid-point of said bottom to said top, said tongue containing a layer of memory material, said memory material being located to cause said tongue to conform to a shape of a foot and shin of said user through use of said tongue, said memory material causing said tongue to retain said shape for subsequent use, an area of said tongue on said lateral side of said imaginary longitudinal line being much larger than an area of said tongue on said medial side of said imaginary longitudinal line.

7. A work boot as claimed in claim 6 wherein a top of said tongue slopes downward from said lateral side to said medial side.

8. A work boot as claimed in claim 7 wherein said tongue has rounded corners extending between said top and said sides.

9. A work boot as claimed in claim 8 wherein there are two work boots, one work boot being shaped to receive a left foot of said user, a second work boot being shaped to receive a right foot of said user, each of said work boots having an anatomical tongue, said tongues being mirror images of one another.

10. A work boot as claimed in claim 8 wherein said memory layer is memory foam.

11. A work boot for use by a user, said work boot comprising a sole, heel and upper, said upper having an anatomical tongue, said tongue having a top, bottom, medial side and lateral side, said bottom having a mid-point between said two sides, when said tongue is in a vertical position, said tongue having an imaginary longitudinal line extending vertically upward from said mid-point to said top, said imaginary longitudinal line lying on a vertical plane, said vertical plane being aligned with an ankle instep molding line of said boot, said tongue containing a layer of memory material, said memory material being located to cause said tongue to conform to a shape of a foot and shin of said user through use of said tongue, said memory material causing said tongue to retain said shape for subsequent use, an area of said tongue on said lateral side of said imaginary longitudinal line being much larger than an area of said tongue on said medial side of said imaginary longitudinal line.

* * * * *